US006830673B2

(12) United States Patent
Yahalom et al.

(10) Patent No.: US 6,830,673 B2
(45) Date of Patent: Dec. 14, 2004

(54) ANODE ASSEMBLY AND METHOD OF REDUCING SLUDGE FORMATION DURING ELECTROPLATING

(75) Inventors: Joseph Yahalom, Emeryville, CA (US); David Starosvetsky, Yokneam Elit (IL); Joseph Hazan, Haifa (IL)

(73) Assignee: Applied Materials, Inc., Santa Clara, CA (US)

( * ) Notice: Subject to any disclaimer, the term of this patent is extended or adjusted under 35 U.S.C. 154(b) by 321 days.

(21) Appl. No.: 10/039,275

(22) Filed: Jan. 4, 2002

(65) Prior Publication Data

US 2003/0150715 A1 Aug. 14, 2003

(51) Int. Cl.[7] ..... C25D 21/12; C25B 15/00

(52) U.S. Cl. ..... 205/83; 204/228.1; 204/229.1; 204/230.1; 204/237; 204/280; 204/292; 204/293; 205/96; 205/292; 205/294

(58) Field of Search ..... 205/83, 96, 292, 205/294; 204/228.1, 229.1, 230.1, 237, 280, 292, 293; 420/500

(56) References Cited

U.S. PATENT DOCUMENTS

| | | | | |
|---|---|---|---|---|
| 2,689,216 A | * | 9/1954 | Nevers et al. | 205/292 |
| 3,915,834 A | | 10/1975 | Wright et al. | 204/267 |
| 4,267,024 A | | 5/1981 | Weiskopf | 204/15 |
| 4,534,832 A | | 8/1985 | Doiron, Jr. | 204/15 |
| 4,828,654 A | | 5/1989 | Reed | 204/23 |
| 5,156,730 A | | 10/1992 | Bhatt et al. | 205/118 |
| 5,256,274 A | | 10/1993 | Poris | 205/123 |
| 5,298,280 A | | 3/1994 | Kaczur et al. | 427/125 |
| 5,443,707 A | | 8/1995 | Mori | 204/242 |
| 5,498,325 A | | 3/1996 | Nishimura et al. | 205/96 |
| 6,093,291 A | | 7/2000 | Izumi et al. | 204/224 R |
| 6,110,346 A | | 8/2000 | Reid et al. | 205/157 |
| 6,126,798 A | | 10/2000 | Reid et al. | 204/282 |
| 6,210,554 B1 | | 4/2001 | Kosaki et al. | 205/96 |
| 6,261,433 B1 | * | 7/2001 | Landau | 205/96 |
| 2003/0000604 A1 | * | 1/2003 | Bishop et al. | 204/293 |

FOREIGN PATENT DOCUMENTS

| | | | |
|---|---|---|---|
| GB | 2102836 | 9/1983 | C25D/5/08 |
| SU | 968104 | 10/1982 | C25D/17/00 |
| WO | WO99/25902 | 5/1999 | C25D/13/00 |
| WO | WO99/25903 | 5/1999 | C25D/5/00 |
| WO | WO99/41434 | 8/1999 | C25D/5/08 |

OTHER PUBLICATIONS

U.S. Appl. No. 09/534,941, Yoneda, filed Mar. 24, 2000.
U.S. Appl. No. 09/586,736, Dordi, filed Jun. 5, 2000.

* cited by examiner

*Primary Examiner*—Robert R. Koehler
(74) *Attorney, Agent, or Firm*—Moser, Patterson & Sheridan

(57) ABSTRACT

A higher applied potential may be provided to a consumable anode to reduce sludge formation during electroplating. For example, a higher applied potential may be provided to a consumable anode by decreasing the exposed surface area of the anode to the electrolyte solution in the electroplating cell. The consumable anode may comprise a single anode or an array of anodes coupled to the positive pole of the power source in which the exposed surface area of the anode is less than an exposed surface area of the cathode to the electrolyte solution. In another example, a higher applied potential may be provided to a consumable anode by increasing the potential of the electroplating cell.

80 Claims, 13 Drawing Sheets

ANODE ASSEMBLY AND METHOD OF REDUCING SLUDGE FORMATION DURING ELECTROPLATING

BACKGROUND OF THE INVENTION

1. Field of the Invention

The present invention generally relates to an anode assembly and method of reducing sludge formation during electroplating. In particular, the present invention relates to reducing sludge formation during electroplating when utilizing a consumable anode.

2. Description of the Related Art

Reliably producing sub-micron and smaller features is one of the key technologies for the next generation of very large scale integration (VLSI) and ultra large scale integration (ULSI) of semiconductor devices. However, as the fringes of circuit technology are pressed, the shrinking dimensions of interconnects in VLSI and ULSI technology have placed additional demands on the processing capabilities. The multilevel interconnects that lie at the heart of this technology require precise processing of high aspect ratio features, such as vias and other interconnects. Reliable formation of these interconnects is very important to VLSI and ULSI success and to the continued effort to increase circuit density and quality of individual substrates.

As circuit densities increase, the widths of vias, contacts and other features, as well as the dielectric materials between them, decrease to sub-micron dimensions, whereas the thickness of the dielectric layers remains substantially constant, with the result that the aspect ratios for the features, i.e., their height divided by width, increases. Many traditional deposition processes have difficulty filling sub-micron structures with relatively severe aspect ratios. Therefore, there is a great amount of ongoing effort being directed at the formation of substantially void-free, sub-micron features having high aspect ratios.

Currently, copper and its alloys have become the metals of choice for sub-micron interconnect technology because copper has a lower resistivity than aluminum, (1.7 $\mu\Omega$-cm compared to 3.1 $\mu\Omega$-cm for aluminum), and a higher current carrying capacity and significantly higher electromigration resistance. These characteristics are important for supporting the higher current densities experienced at high levels of integration and increased device speed. Further, copper has a good thermal conductivity and is available in a highly pure state.

Electroplating is one process being used to fill high aspect ratio features with a conductive material, such as copper, on substrates. Electroplating processes typically require a thin, electrically conductive seed layer to be deposited on the substrate. Electroplating is accomplished by applying an electrical current to the seed layer and exposing the substrate to an electrolyte solution containing metal ions which plate over the seed layer. The seed layer typically comprises a conductive metal, such as copper, and is conventionally deposited on the substrate using physical vapor deposition (PVD) or chemical vapor deposition (CVD) techniques. Finally, the electroplated layer may be planarized, for example by chemical mechanical polishing (CMP), to define a conductive interconnect feature.

Typically, electroplating is accomplished by applying a constant electrical current between the anode and the cathode rather than applying a constant electrode potential to the anode or the cathode. In the course of applying a constant electrical current, the voltage of the entire electroplating cell or the potential difference between the anode and the cathode is monitored rather than the potentials at the cathode and at the anode. Due to changes of the processing conditions during electroplating, the electrode potentials of the anode and the cathode vary during the course of electroplating.

One problem with electroplating processes is the formation of particles or sludge in the solution generated as metal is dissolved from a consumable anode, such as a consumable copper anode, during electroplating. The sludge may contaminate or damage the substrates during electroplating. Since cleanliness of the substrates is important for their functionality, contamination by particles should be minimized. Two mechanisms have been proposed for the formation of sludge, such as copper sludge from a consumable copper anode. The first mechanism theorizes that monovalent copper ions ($Cu^{1+}$) are formed during electroplating in the electrolyte solution which are then both oxidized and reduced to form sludge in the solution. The following reactions illustrate the first mechanism.

$$2Cu\ (s)\ (anode) \rightarrow 2Cu^{1+} 2e^{-} \rightarrow Cu(s)\ (in\ solution\ as\ sludge) + Cu^{2+}$$

The second mechanism theorizes that dissolution of the anode at grain boundaries causes the release of whole metal grains into the electrolyte solution.

One apparatus directed at addressing the problems of sludge formation is the use of a permeable membrane covering the anode. For example, FIG. 1 is a cross sectional view of one embodiment of an anode assembly 10 comprising a consumable anode plate 14, such as a consumable copper anode plate, encapsulated by a permeable membrane 12. The material of the permeable membrane 12 is selected to filter sludge passing from the anode plate 14 into the electrolyte solution, while permitting ions (i.e. copper ions) generated by the anode plate 14 to pass from the anode plate 14 to the cathode. The permeable membrane 12 comprises a hydrophilic porous membrane, such as a modified polyvinylidene fluoride membrane, having porosity between about 60% and 80% and pore sizes between about 0.025 $\mu$m and about 1 $\mu$m.

One example of a hydrophilic porous membrane is the Durapore Hydrophilic Membrane, available from Millipore Corporation, located in Bedford, Mass. The anode plate 14 is secured and supported by a plurality of electrical contacts or feed-throughs 16 that extend through the bottom of the bowl 18. The electrical contacts or feed-throughs 16 extend through the permeable membrane 12 into the bottom surface of the anode plate 14. The electrolyte solution flows from an electrolyte inlet 19 disposed at the bottom of the bowl 16 and through the permeable membrane 12. As the electrolyte solution flows through the permeable membrane, sludge and particles generated by the dissolving anode are filtered or trapped by the permeable membrane 12. Thus, the permeable membrane 12 improves the purity of the electrolyte during the electroplating process, and defect formations on the substrate during the electroplating process caused by sludge from the anode are reduced. However, one problem with the use of a permeable membrane is that some sludge may still be present outside the permeable membrane. In addition, because of the accumulation of sludge on the permeable membrane, the permeable membrane must be replaced or cleaned.

Another apparatus directed at addressing the problems of sludge formation is the use of a phosphorized copper consumable anode. Typically, a phosphorized copper consumable anode contains about 0.02% to about 0.07% of phosphorous. It is believed that the phosphorous poisons the reaction of the theorized first mechanism of the formation of sludge, discussed above. However, it has been observed that phosphorized copper consumable anodes still produce sludge.

Therefore, there is a need for an improved apparatus and method directed at reducing the formation of sludge.

SUMMARY OF THE INVENTION

In one embodiment, a higher applied potential may be provided to a consumable anode to reduce sludge formation during electroplating. For example, a higher applied potential may be provided to a consumable anode by decreasing the exposed surface area of the anode to the electrolyte solution in the electroplating cell. The consumable anode may comprise a single anode or an array of anodes coupled to the positive pole of the power source in which the exposed surface area of the anode is less than an exposed surface area of the cathode to the electrolyte solution. In another example, a higher applied potential may be provided to a consumable anode by increasing the potential of the electroplating cell. A combination of decreasing the exposed surface area of the anode and increasing the potential of the electroplating cell may be used to provide a higher applied potential to a consumable anode.

In another embodiment, an anode may comprise a copper alloy including Ag, Be, Bi, Cb(Nb), Cd, Co, Cr, Fe, Hf, In, Ir, Mo, P, Sb, Se, Sr, Sn, Ta, Te, Th, Ti, Tl, V, Y, Zr, and combinations thereof to reduce the formation of anode sludge.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 2:
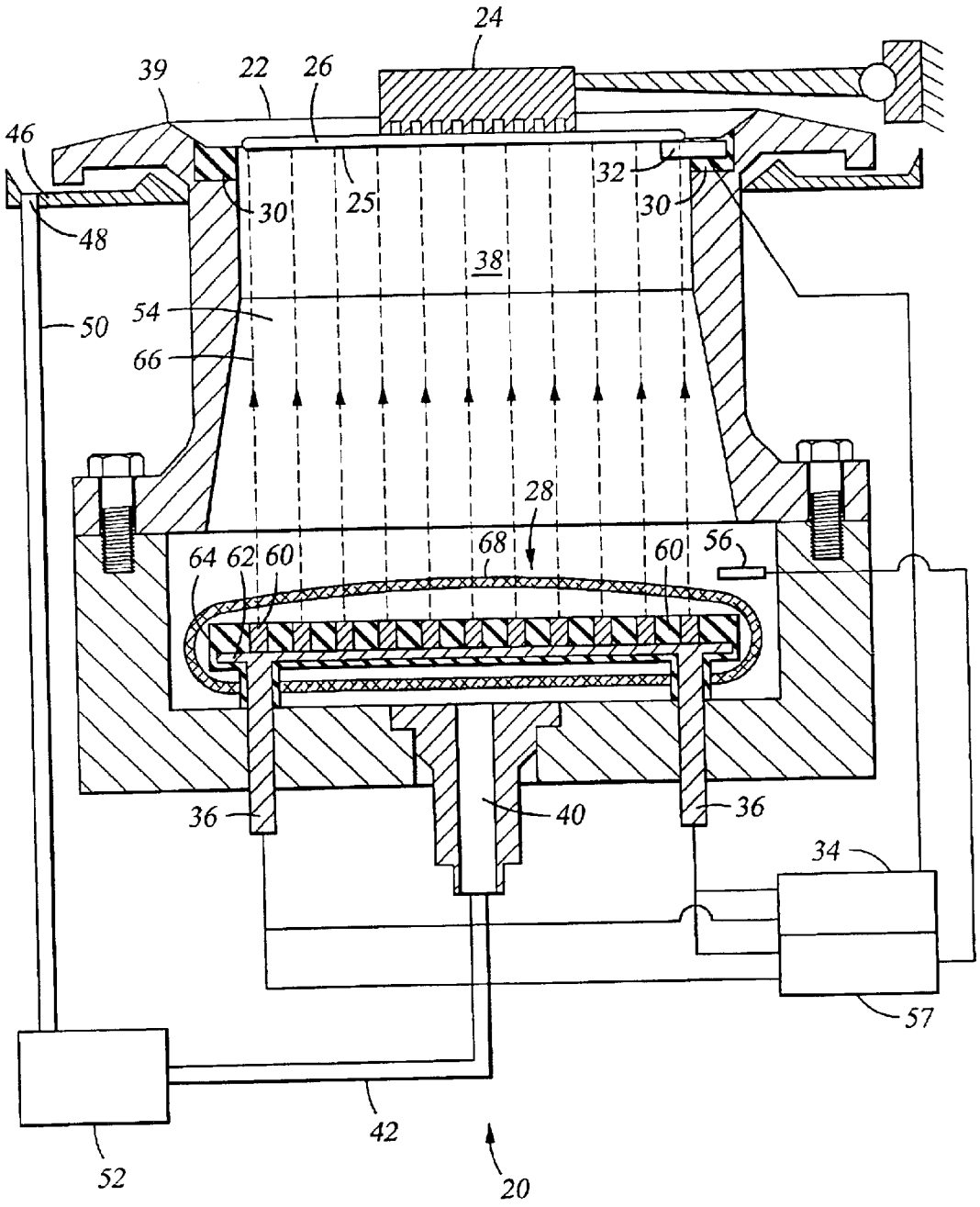
FIG. 2 is a cross sectional view of one embodiment of an electroplating cell including one embodiment of an anode assembly.

FIG. 2 is a cross sectional view of one embodiment of an electroplating cell 20, known as a fountain plater. The cell 20 includes a top opening 22, a movable substrate support 24 positioned above the top opening 22 to support a substrate 26 in an electrolyte solution, and a consumable anode assembly 28 disposed near a bottom portion of the cell 20.

A contact ring 30 is configured to secure and support a substrate 26 in position during electroplating, and permits the electrolyte solution contained in the cell 20 to contact the surface 25 of the substrate 26 while it is immersed in an electrolyte solution. A negative pole of a power supply 34 is connected to a plurality of contacts 32 (only one is depicted in figure) of the contact ring 30 which are typically mounted about the periphery of the substrate 26 to provide multiple circuit pathways to the substrate 26, and thereby limit irregularities of the current applied to a seed layer formed on the surface 25 of substrate 26. Feed throughs 36 or any other known type of support attach to the anode assembly 28 to support the anode assembly 28 in position and to couple a positive pole of the power supply 34 to the anode assembly 28. Feed throughs 36 releasably attach to the anode assembly 28 so that the anode assembly 28 may be easily replaced or removed.

An electrolyte solution is supplied to a cavity 38 defined within the cell 20 via electrolyte input port 40 from electrolyte input supply 42. During electroplating, the electrolyte solution is supplied to the cavity 38 so that the electrolyte solution overflows from a lip 39 into an annular drain 46. The annular drain 46 drains into electrolyte output port 48 which discharges to electrolyte output 50. Electrolyte output 50 is typically connected to the electrolyte input supply 42 via a regeneration element 52 that provides a closed loop for the electrolyte solution contained within the cell 20, such that the electrolyte solution may be recirculated, maintained, and chemically refreshed. The motion associated with the recirculation of the electrolyte also assists in transporting the electrolyte solution from the anode assembly 28 to the surface 25 of the substrate 26.

The substrate 26 is positioned within an upper portion 54 of the cell 20, such that the electrolyte solution flows along the surface 25 of the substrate 26 during operation. A negative charge applied from the negative pole of the power supply 34 via the contacts 32 to a seed layer deposited on plating surface 25 of substrate 26 in effect makes the substrate a cathode. The metal ions may be added to the electrolyte solution and/or may be supplied by a consumable anode assembly. The seed layer formed on the surface 25 of the substrate 26 attracts metal ions carried by the electrolyte solution to electroplate a metal on a surface 25 of a substrate 26.

In one embodiment, the cell may optionally further include a reference electrode 56, such as a calomel saturated electrode or any other electrode assemblies that have an electrode potential independent of the electrolyte solution used in the cell 20, disposed proximate the anode assembly 28. The reference electrode 56 may be used to monitor the potential applied to the anode. Therefore, the reference electrode 56 may be used for in situ adjustment of the current applied to the anode in order to provide a certain applied potential to the anode.

One embodiment of a consumable anode assembly 28 having an exposed surface area less than an exposed surface area of a cathode-substrate to an electrolyte solution comprises an array of anode rods 60 in contact with an anode plate 62 or another connection device to electrically couple the anode rods 60 to the power supply 34.

Figure 3:
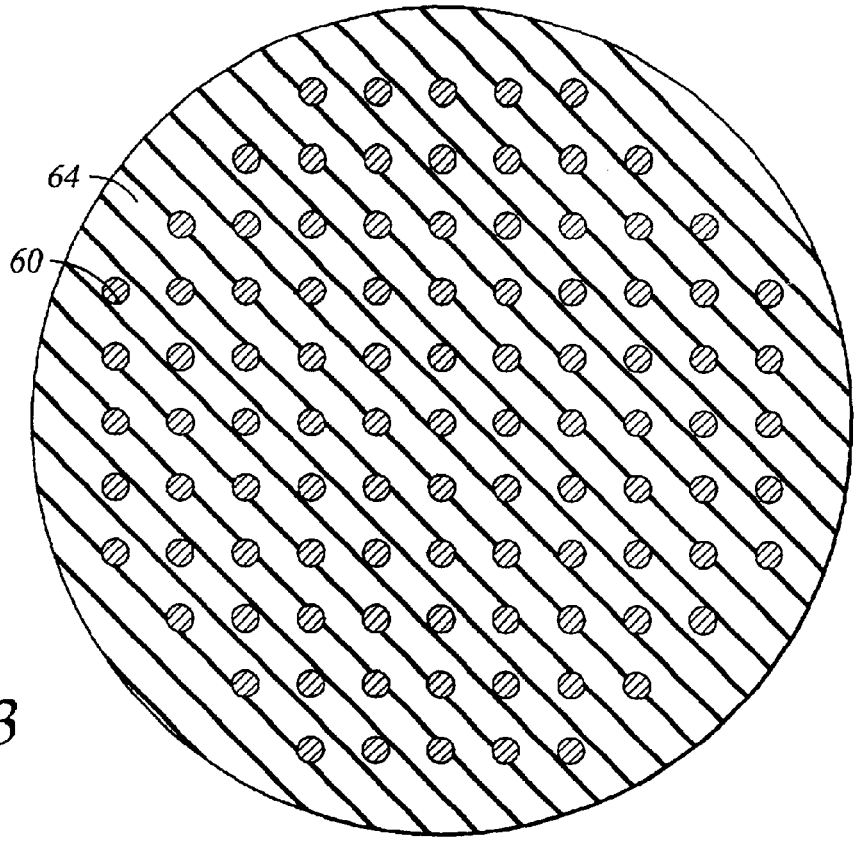
FIG. 3 is a top view of the anode assembly of FIG. 2.

An insulator 64 which is impermeable to fluid surrounds the anode rods 60 and the anode plate 62 so that only a top surface of the anode rods 60 is exposed to an electrolyte solution in the cell 20. FIG. 3 is a top schematic view of the anode assembly 28 of FIG. 2. The insulator may also surround the feed throughs 36. As a consequence, a current is supplied to the electrolyte solution in the cell 20 from the top surface of the anode rods 60 of the anode assembly 28. In one embodiment, the anode rods 60 span a diameter less than the diameter of the substrate 26. In another embodiment as shown in FIGS. 2 and 3, the anode rods 60 span a diameter substantially equal to the diameter of the substrate 26. Anode rods 60 spanning a diameter substantially equal to the substrate 26 provide a substantially homogenous electric field 66 to the substrate 26. In one aspect, it is believed that a homogenous field across the cathode-substrate provides a more consistent electrolyte solution contacting the plating surface and thereby plates the metal over the substrate at a more even depth. In addition, the anode assembly 28 may optionally further include a permeable membrane 68 covering the anode rods 60. In one aspect, since the anode rods 60 are only exposed to the electrolyte solution, only the anode rods 60 need to be replaced as a consequence of being consumed in the electroplating process.

Figure 5:
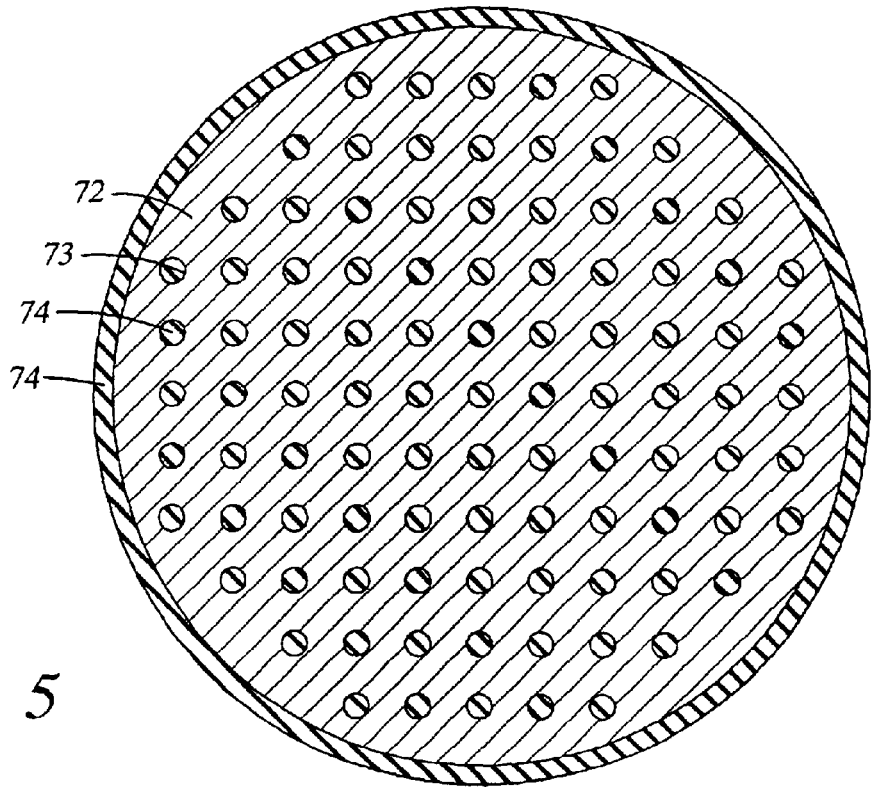
FIG. 5 is a top view of the anode assembly of FIG. 4.
Figure 4:
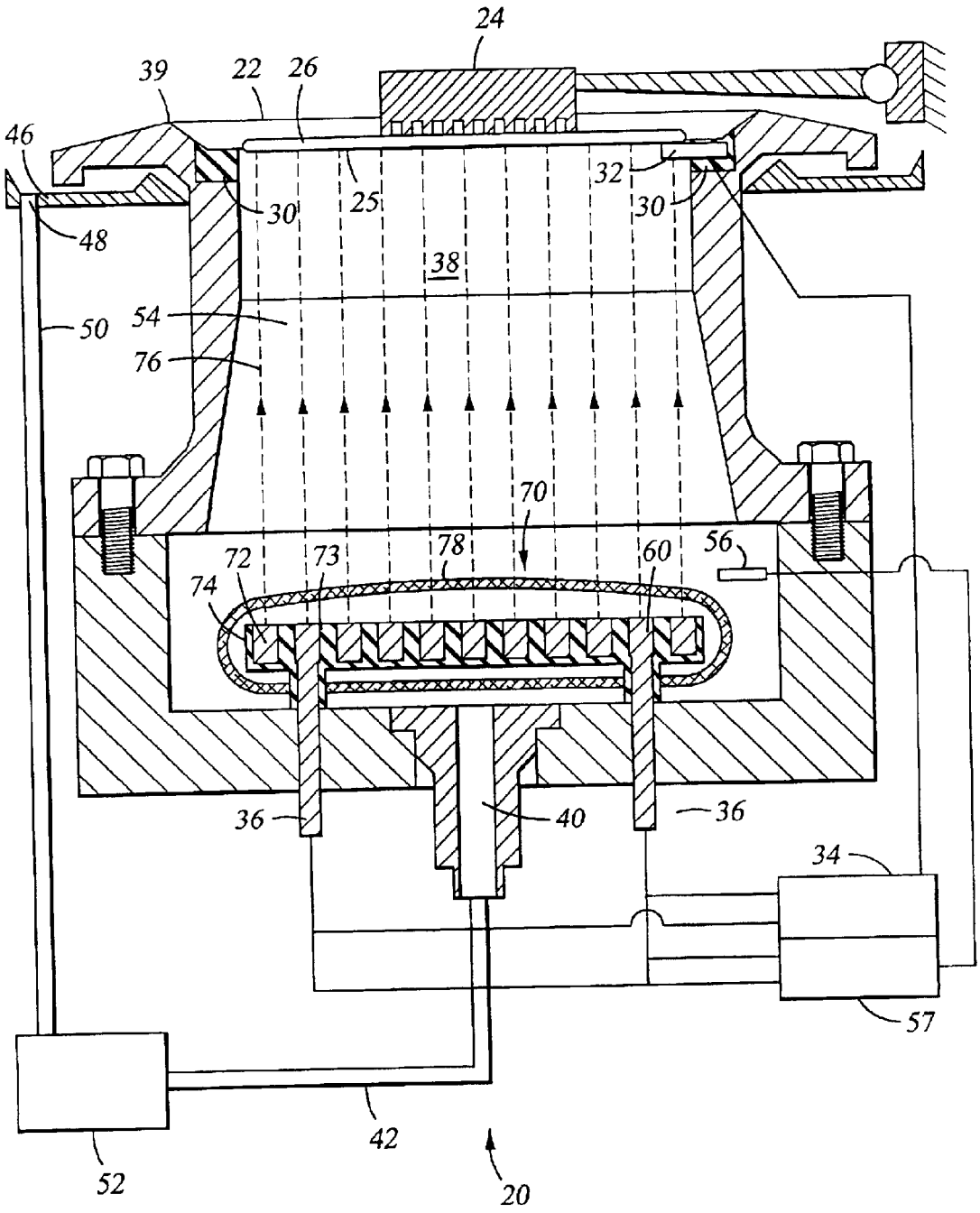
FIG. 4 is a cross sectional view of an electroplating cell including another embodiment of an anode assembly.

FIG. 4 is a cross sectional view of another embodiment of a consumable anode assembly 70 having an exposed surface area less than an exposed surface area of a cathode-substrate to an electrolyte solution. The anode assembly 70 comprises a perforated anode plate 72 comprising holes 73 formed therethrough. An insulator 74 which is impermeable to fluid surrounds the perforated anode plate 72 and is disposed inside holes of the perforated anode plate so that only a top surface of the anode plate 72 is exposed to an electrolyte solution in the cell 20. FIG. 5 is a top schematic view of the anode assembly 70 of FIG. 4. The insulator may also surround the feed throughs 36. As a consequence, a current is supplied to the electrolyte solution in the cell 20 from the top surface of the anode plate 72 of the anode assembly 70. In one embodiment, the anode plate 72 spans a diameter less than the diameter of the substrate 26. In another embodiment as shown in FIGS. 4 and 5, the anode plate 72 spans a diameter substantially equal to the diameter of the substrate 26. Anode plate 72 spanning a diameter substantially equal to the substrate 26 provides a substantially homogenous electric field 76 to the substrate 26. The anode assembly 70 may optionally further include a permeable membrane 78 covering the anode plate 72.

Figure 6:
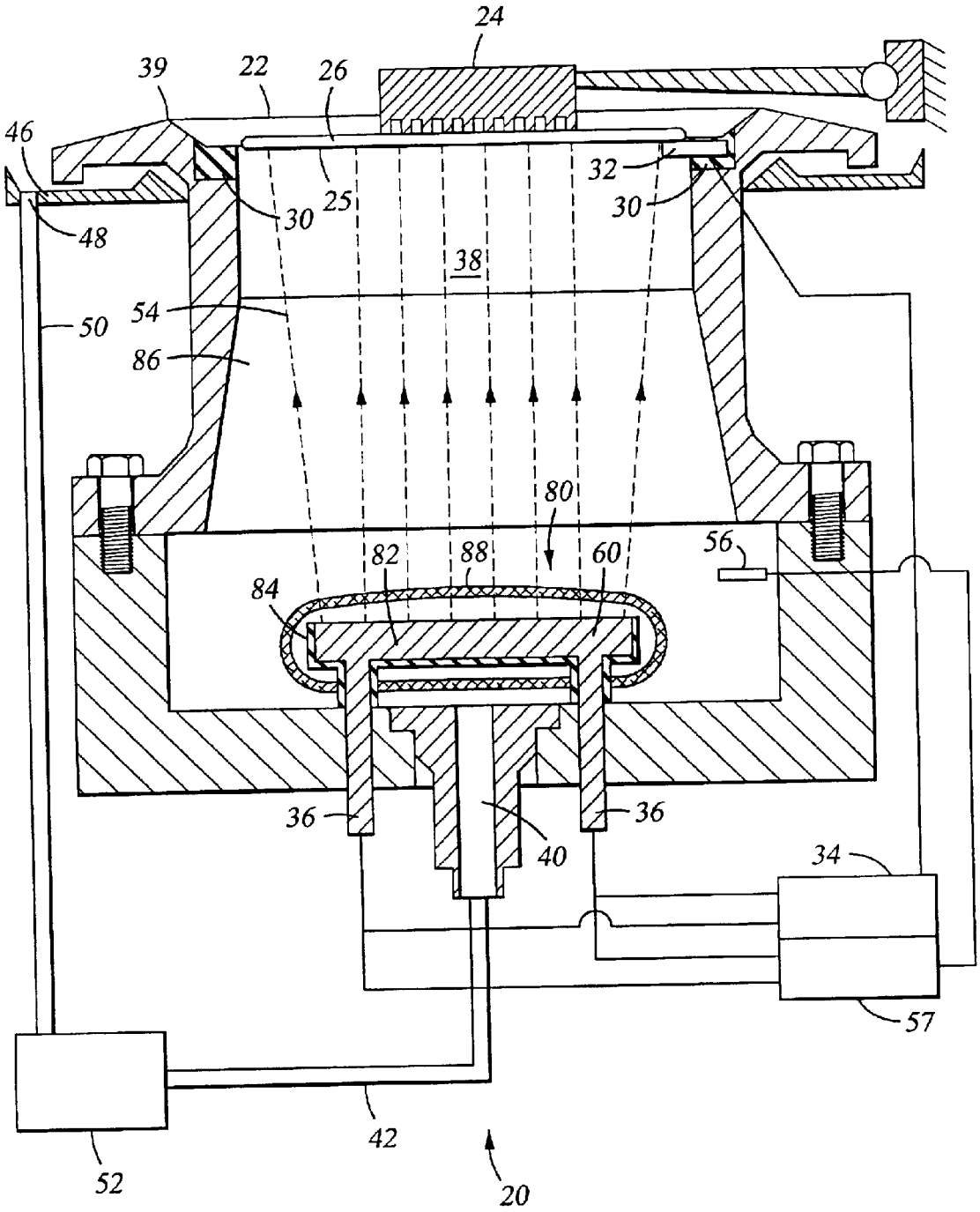
FIG. 6 is a cross sectional view of an electroplating cell including still another embodiment of an anode assembly.
Figure 7:
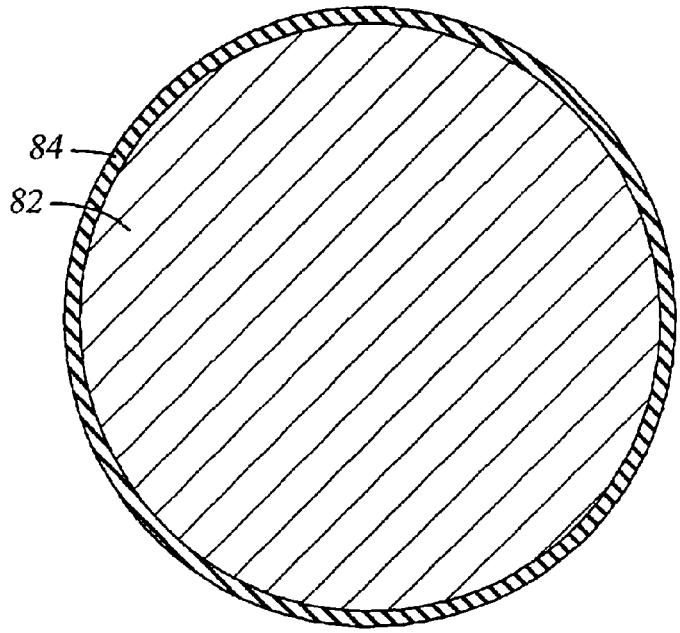
FIG. 7 is a top view of the anode assembly of FIG. 6.

FIG. 6 is a cross sectional view of another embodiment of a consumable anode assembly 80 having an exposed surface area less than an exposed surface area of a cathode-substrate to an electrolyte solution. The anode assembly 80 comprises an anode plate 82 having a diameter less than the diameter of the substrate 26. An insulator 84 which is impermeable to fluid surrounds the anode plate 82 so that only a top surface of the anode plate 82 is exposed to an electrolyte solution in the cell 20. FIG. 7 is a top schematic view of the anode assembly 80 of FIG. 6. The insulator may also surround the feed throughs 36. As a consequence, the current is supplied to the electrolyte solution from the top surface of the anode plate 82 of the anode assembly 80. The anode assembly 80 may optionally further include a permeable membrane 88 covering the anode plate 82. In one aspect, the anode plate 82 spans a diameter less than the diameter of the substrate 26 to provide a non-homogenous electric field 86 to the substrate 26. In one aspect, a non-homogenous electric field 86 provided by the anode plate 82 having a diameter less than the diameter of the substrate reduces the "edge effect" occurring during electroplating of a substrate. The edge effect is when electroplating occurs more rapidly at the edges of a substrate. It is believed, that a non-homogenous electric field provided by the anode plate 82 having a diameter less than the diameter of the substrate reduces the electric field generated at the edges of the substrate 26 and thus reduces electroplating at the edges of a substrate.

Figure 9:
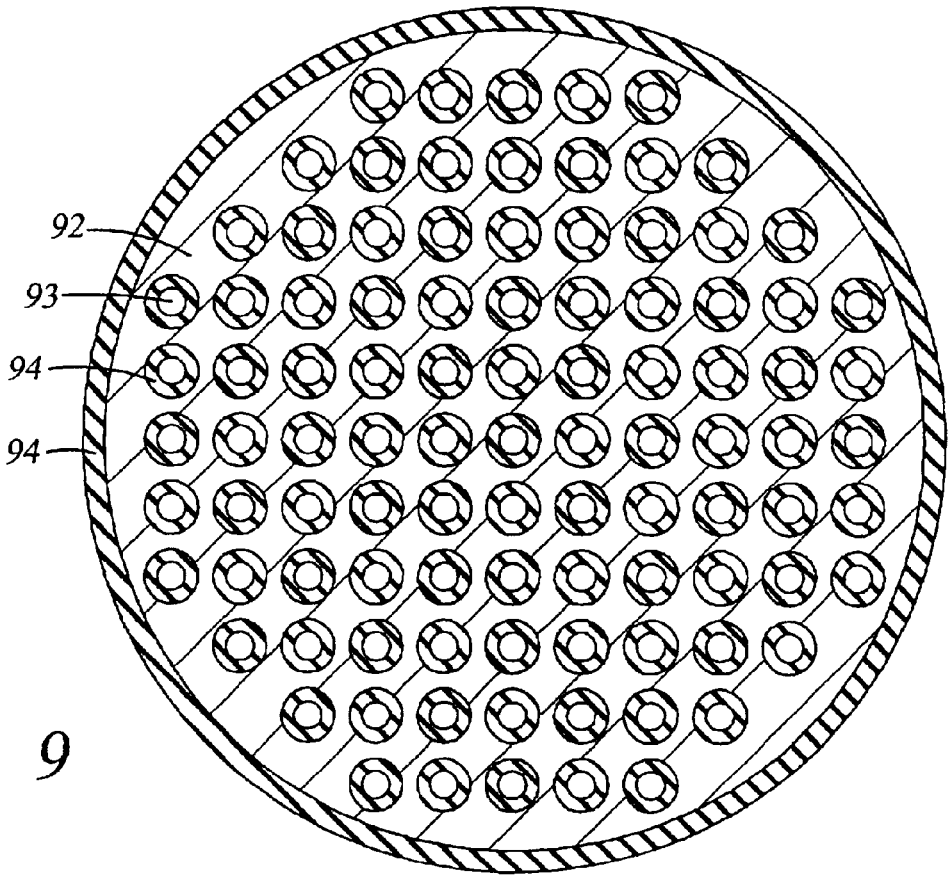
FIG. 9 is a top view of the anode assembly of FIG. 8.
Figure 8:
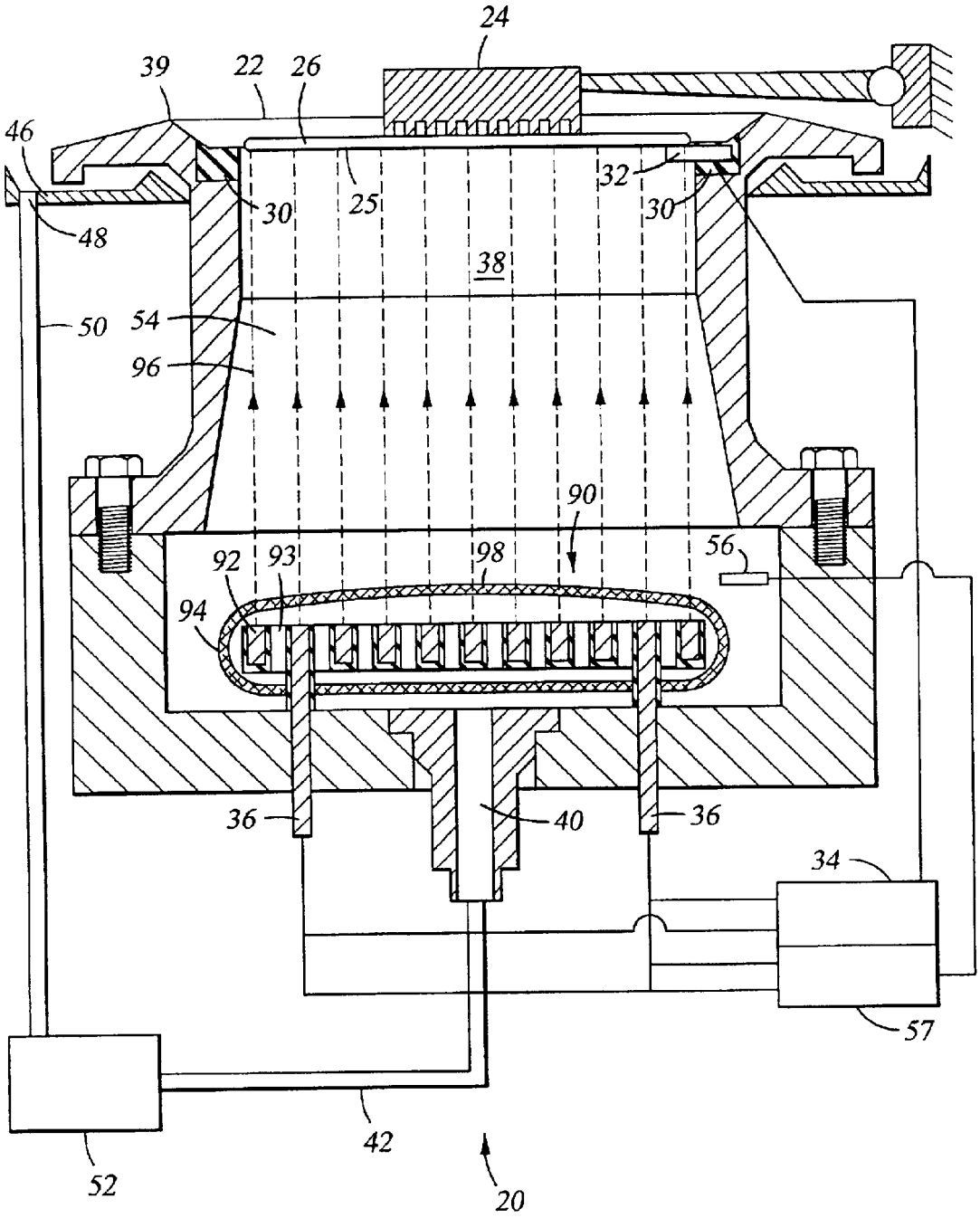
FIG. 8 is a cross sectional view of an electroplating cell including yet another embodiment of an anode assembly.

FIG. 8 is a cross sectional view of another embodiment of a consumable anode assembly 90 having an exposed surface area less than an exposed surface area of a cathode-substrate to an electrolyte solution. The anode assembly 90 comprises a perforated anode plate 92 comprising holes 93 formed therethrough. Alternatively, the anode assembly 90 may comprise a mesh (not shown) comprising holes formed therethrough. An insulator 94 which is impermeable to fluid surrounds the perforated anode plate 92 and lines the holes 93 of the perforated anode plate 92 so that only a top surface of the anode plate 92 is exposed to an electrolyte solution in the cell 20. FIG. 9 is a top schematic view of the anode assembly 90 of FIG. 8. The insulator 94 lines the holes 93 of the perforated anode 92 so that an electrolyte solution may flow through the perforated anode plate 92. The insulator 94 may also surround the feed throughs 36. As a consequence, a current is supplied to an electrolyte solution in the cell 20 from the top surface of the perforated anode plate 92 of the anode assembly 90. In one embodiment, the perforated anode plate 92 spans a diameter less than the diameter of the substrate 26. In another embodiment as shown in FIGS. 7 and 8, the perforated anode plate 92 spans a diameter substantially equal to the diameter of the substrate 26. The perforated anode plate 92 spanning a diameter substantially equal to the substrate 26 provides a substantially homogenous electric field 96 to the substrate 26. The anode assembly 90 may optionally further include a permeable membrane 98 covering the anode plate 92.

In one embodiment, the exposed surface area of the anode assembly 28, 70, 80, 90 (FIGS. 2, 4, 6, 8) is less than the exposed surface area of the cathode-substrate 26 to provide a higher applied potential at the anode assembly due to the higher current density of the anode assembly when maintaining a desired current density to the cathode-substrate. For instance, for a first anode and for a second anode providing the same current density to a cathode-substrate in electrochemical cells having the same electrochemical cell geometry in which the first anode has a smaller exposed surface area than the second anode, the first anode with a smaller exposed surface area than the second anode provides a higher current density and thus is at a higher applied potential since the total amount of current flowing to the cathode-substrate must be equal to the total amount of current flowing from the anode, In one embodiment, the upper limit of the exposed surface area of the anode assembly 28, 70, 80, 90 (FIGS. 2, 4, 6, 8) is less than or equal to about ½ the exposed surface area of the cathode-substrate 26, preferably is less than or equal to about ⅓ the exposed surface area of the cathode-substrate, and more preferably is less than or equal to about ¼ the exposed surface area of the cathode-substrate. In one embodiment, the lower limit of the exposed surface area of the anode assembly 28, 70, 80, 90 (FIGS. 2, 4, 6, 8) is greater than or equal to 1/12 the exposed surface area of the cathode-substrate 26, preferably is greater than or equal to 1/10 the exposed surface area of the cathode-substrate.

Figure 1:
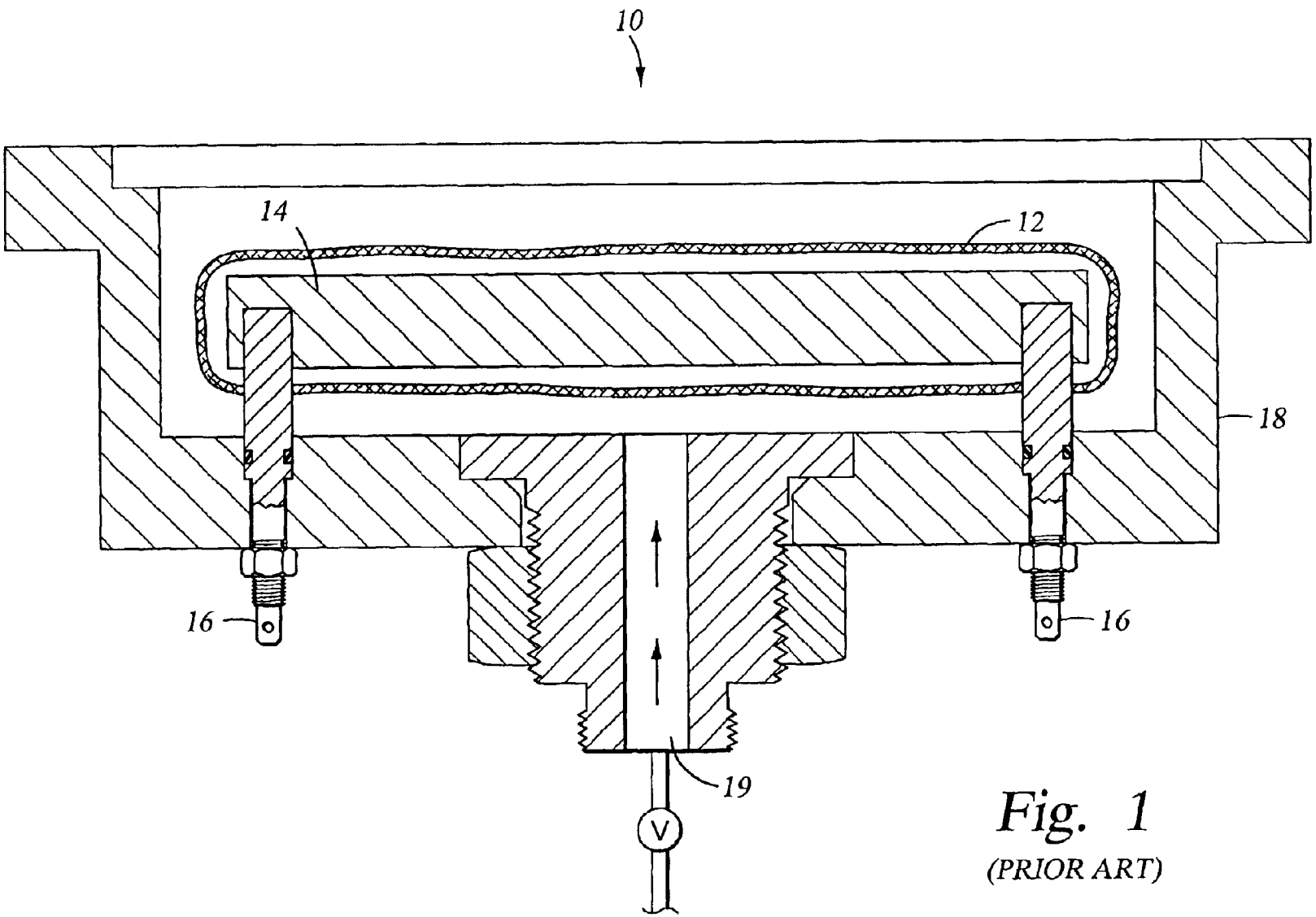
Fig. 1 (PRIOR ART)
FIG. 1 is a cross sectional view of one embodiment of a consumable anode encapsulated by a permeable membrane.

It has been found that a higher applied potential to any consumable anode, such as the anode assembly 14 of FIG. 1 and the anode assemblies 28, 70, 80, and 90 of FIGS. 2–9, causes a decrease in the formation of anode sludge. Not wishing to be bound by theory, it is believed that a higher applied potential to any consumable anode, such as the anode assembly 14 of FIG. 1 and the anode assemblies 28, 70, 80, and 90 of FIGS. 2–9, results in a decrease in the formation of anode sludge because of the greater oxidation of the anode to $Cu^{2+}$ metal ions rather than to $Cu^{1+}$ metal ions. In addition, it is believed that a higher applied potential to any consumable anode, such as the anode assembly 14 of FIG. 1 and the anode assemblies 28, 70, 80, and 90 of FIGS. 2–9, will stifle the tendency for the release of whole metal grains of the anode into the electrolyte solution by decreasing the relative difference in the free energy for dissolution of the grains in comparison to their boundaries.

In one embodiment, in the alternative or in combination with providing an anode assembly 28, 70, 80, 90 (FIGS. 2, 4, 6, 8) with reduced exposed surface area, a higher applied potential to a consumable anode may be provided to an anode, such as an anode assembly 14 of FIG. 1 and the anode assemblies 28, 70, 80, and 90 of FIGS. 2–9, by increasing the cell potential of an electroplating chamber, such as an electroplating cell 20 of FIGS. 2, 4, 6, and 8. However, since the cell potential generally increases with the current density, a greater cell potential results in a higher current density at the cathode-substrate. Typically, a certain current density is desirable at the cathode-substrate to provide optimal plating of the cathode-substrate. For example, if the current density at the cathode-substrate is too high, then the rate of electroplating of the cathode-substrate may occur too quickly and incorporate too many impurities in the electroplated layer. Therefore, a higher applied potential to the anode may be provided by increasing the cell potential as long as the current density of the cathode-substrate provides for an acceptable deposition rate. In one embodiment, the current density provided to any cathode-substrate, such as the cathode substrate 26 of FIGS. 2, 4, 6, and 8, for the electroplating of copper is between about 5 $mA/cm^2$ and about 600 $mA/cm^2$, preferably between about 10 $mA/cm^2$ and about 60 $mA/cm^2$. In one embodiment, the current density may be tailored to a certain level by controlling the cell resistance. For example, the distance between the anode, such as the anode assemblies 28, 70, 80, and 90 of FIGS. 2, 4, 6, and 8, and the cathode-substrate 26 may be varied and/or the conductivity of the electrolyte solution may be varied.

In one embodiment, whether reducing the exposed surface area of the anode assembly 28, 70, 80, and 90 (FIGS. 2, 4, 6, 8) and/or increasing the cell potential (i.e. to a electroplating cell 20 of FIGS. 2, 4, 6, and 8), "a higher applied potential" to a consumable anode (i.e. such as to an anode assembly 14 of FIG. 1 or the anodes assemblies 28, 70, 80, 90 of FIGS. 2–9) corresponds to applying a current between the consumable anode and a cathode-substrate so that the potential of the consumable anode is greater than or equal to about 0.7 V in reference to a saturated calomel electrode (SCE) or is greater than or equal to about 0.9 V in reference to the normal hydrogen scale (since the electrode potential of a saturated calomel electrode is +0.2444V at 25° C. in reference to the normal hydrogen scale). In another embodiment, "a higher applied potential" to a consumable anode corresponds to applying a current between the consumable anode (i.e. such as to an anode assembly 14 of FIG. 1 or the anodes assemblies 28, 70, 80, 90 of FIGS. 2–9) and a cathode-substrate so that the potential of the consumable anode is greater than or equal to about 2.0 V in reference to a saturated calomel electrode or is greater than or equal to about 2.2 V in reference to the normal hydrogen scale. In another embodiment, "a higher applied potential" to a consumable anode corresponds to applying a current between the consumable anode (i.e. such as to an anode assembly 14 of FIG. 1 or the anodes assemblies 28, 70, 80, 90 of FIGS. 2–9) and a cathode-substrate so that the potential of the consumable anode is greater than or equal to about 3.5 V in reference to a saturated calomel electrode or is greater than or equal to about 3.7 V in reference to the normal hydrogen scale.

The corresponding current densities of the cathode-substrate and the anode at a higher applied potential to the anode depend on the characteristics of the electrochemical cell and the electrolyte solution. In general, a higher applied potential correlates to a higher current density. In one embodiment, the current density at anode assemblies 28, 70, 80, and 90 (FIGS. 2, 4, 6, 8) with reduced exposed surface area is greater than about 40 $mA/cm^2$, and preferably greater than or equal to about 90 $mA/cm^2$. In one embodiment, the current density at anode assemblies 28, 70, 80, 90 (FIGS. 2, 4, 6, 8) with reduced surface area is less than 200 $mA/cm^2$ because if the current density is too high at the anode than the anode will be consumed too quickly necessitating constant replacement and lowering throughput through the system.

A higher applied potential to a consumable anode, such as the anode assembly 14 of FIG. 1 and the anode assemblies 28, 70, 80, 90 of FIGS. 2–9, may be maintained by controlling the potential applied to the consumable anode at a desired value or range by adjusting the current density applied to the consumable anode. The higher applied potential to a consumable anode, such as the anode assembly 14 of FIG. 1 and the anode assemblies 28, 70, 80, and 90 of FIGS. 2–9, may be maintained during any portion of electroplating of a cathode-substrate. In one embodiment, a higher applied potential is applied for a time period of about 50% or more of the time period of electroplating of a cathode-substrate. In another embodiment, a higher applied potential is applied for substantially an entire period of electroplating of a cathode-substrate.

In one embodiment, the potential applied to the consumable anode may be controlled by monitoring the potential of the consumable anode with a reference electrode, such as a reference electrode 56 (FIGS. 2, 4, 6, 8) used with a consumable anode of any size, shape, or exposed surface area, and by adjusting the current density applied to the consumable anode accordingly. In another embodiment, the potential applied to the consumable anode, such as the anode assembly 14 of FIG. 1 and the anode assemblies 28, 70, 80, and 90 of FIGS. 2–9, may be controlled by predetermining the relationship of an applied current between the consumable anode and a cathode-substrate under a constant applied potential to the consumable anode over time for electroplating of a type of cathode-substrate with a type of consumable anode in a type of electroplating cell in a type of electroplating solution. Once this relationship has been determined, the applied potential to the consumable anode, such as the anode assembly 14 of FIG. 1 and the anode assemblies 28, 70, 80, 90 of FIGS. 2–9, may be provided by adjusting the applied current between the consumable anode and the cathode-substrate based upon this relationship. In yet another embodiment, a sufficient applied current may be supplied to a consumable anode, such as the anode assembly 14 of FIG. 1 and the anode assemblies 28, 70, 80, 90 of FIGS. 2–9, and a cathode-substrate so that the anode remains above a desired potential for a substantial period of time during electroplating without measuring the applied potential to the anode.

In one embodiment, the consumable anode, such as the anode assembly 14 of FIG. 1 and the anode assemblies 28, 70, 80, and 90 of FIGS. 2–9, comprises copper in order to produce copper metal ions in the solution to plate on the cathode-substrate. In addition to or in alternative of providing a higher applied potential to a consumable anode, the copper consumable anode, such as the anode assembly 14 of FIG. 1 and the anode assemblies 28, 70, 80, 90 of FIGS. 2–9, may further comprise Ag, Be, Bi, Cb(Nb), Cd, Co, Cr, Fe, Hf, In, Ir, Mo, P, Sb, Se, Sr, Sn, Ta, Te, Th, Ti, Tl, V, Y, Zr, and combinations thereof to reduce the formation of anode sludge. It is believed that these materials form a precipitate of copper on grain boundaries preventing the release of whole anode grains into the electrolyte solution. It has been observed that a copper anode comprising tellurium produced a reduced amount of anode sludge. Thus, it is believed that any copper anode, such as the anode assembly 14 of FIG. 1 and the anode assemblies 28, 70, 80, 90 of FIGS. 2–9, further comprising tellurium will reduce the amount of anode sludge formed during electroplating.

The embodiments as describe herein may be used with any electroplating cell.

EXAMPLES

Figure 10:
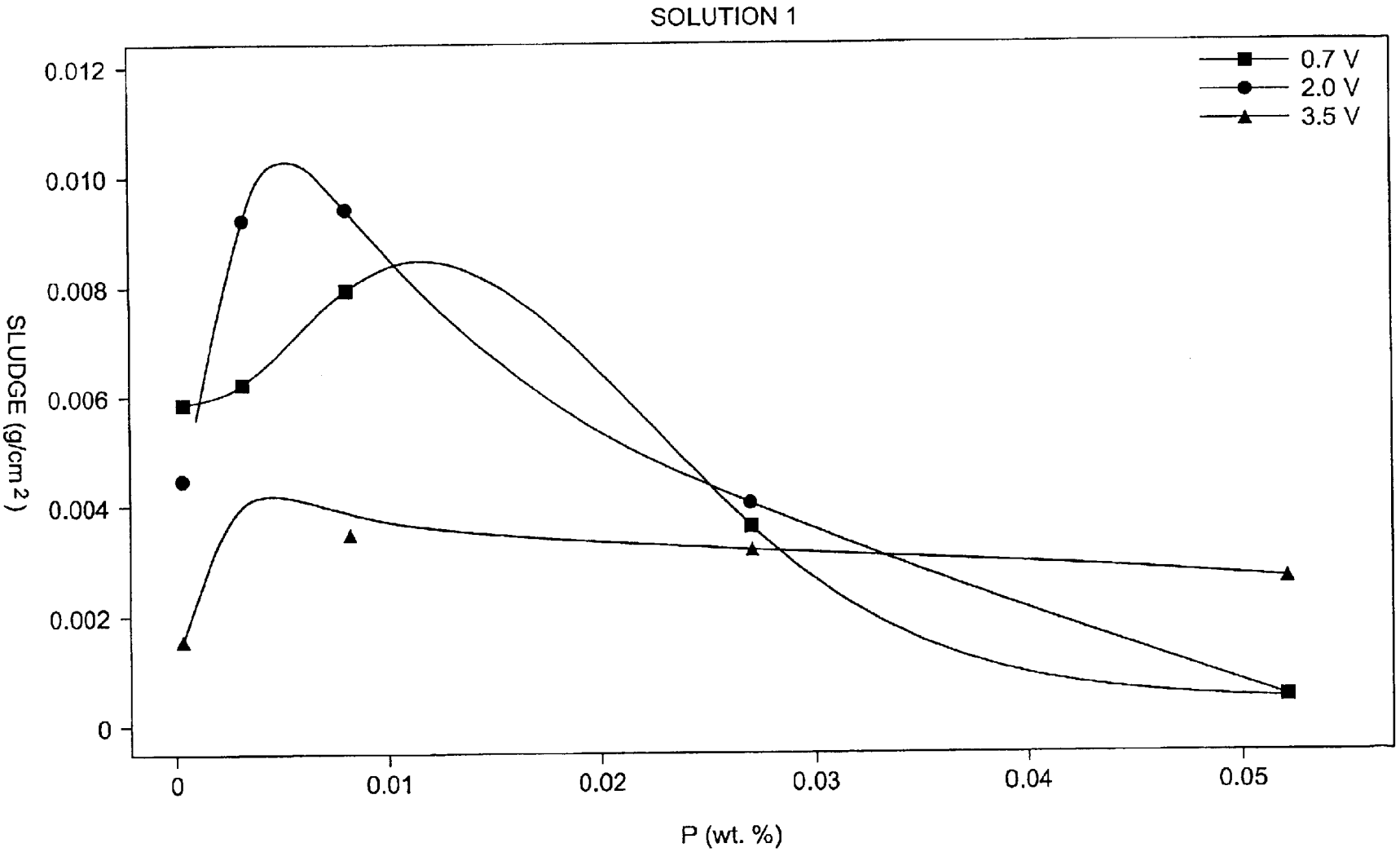
FIG. 10 is a graph of the amount of sludge produced at potentiostatic conditions of copper alloy anodes over the phosphorous content of the anodes in solution #1.
Figure 11:
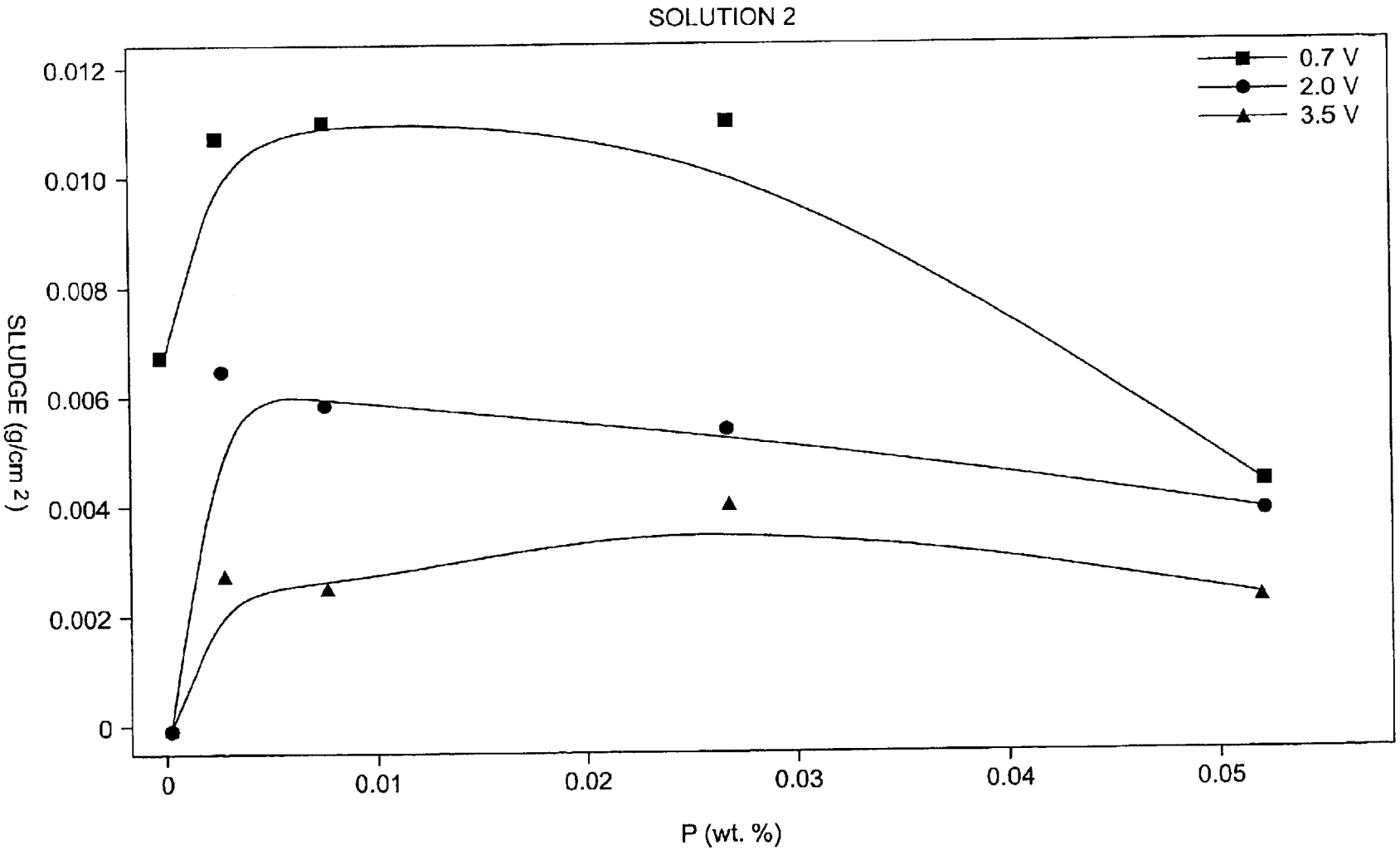
FIG. 11 is a graph of the amount of sludge produced at potentiostatic conditions of copper alloy anodes over the phosphorous content of the anodes in solution #2.

Various anodes comprising one of the copper alloys as set forth in Table 1 were evaluated in an electrolyte solution under electroplating conditions. Each anode was formed had an exposed area limited to about 1040 $mm^2$. The anodes were expected to model the consumable anodes of FIGS. 1–9 and to model the mechanism of sludge formation therefrom. Two solutions were used were as set forth in Table 2 which are examples of solutions which can be use to electroplate copper over substrate structures, such as the substrate structures of a semiconductor wafer. The anodes were tested under potentiostatic conditions exposed to solution 1 and solution 2. The anodes where tested for 1 hour at a constant applied potentials of about 0.7 V, about 2.0 V, and about 3.5 V at the anode as measured by a saturated calomel electrode (SCE) and the amount of sludge produced was measured. Table 3 shows the amount of sludge formed from the anodes under potentiostatic conditions in solution #1. Table 4 shows the amount of sludge formed from the anodes under potentiostatic conditions in solution #2. As can be seen, generally at a higher applied potential to the anode the amount of sludge produced was less. FIG. 10 is a graph of the amount of sludge produced at the potentiostatic conditions of about 0.7 V, about 2.0 V, and about 3.5 V over the phosphorous content of the anodes in solution #1. FIG. 11 is a graph of the amount of sludge produced at the potentiostatic conditions of about 0.7 V, about 2.0 V, and about 3.5 V over the phosphorous content of the anodes in solution #2. FIG. 10 and FIG. 11 show that the applied potential to the anode is the main factor affecting sludge formation for all alloys in both solutions rather the amount of phosphorous contained in the anodes.

Scanning electron microscope photographs of copper alloy anodes after anodic polarization in solutions 1 and 2 at the applied potential of about 0.7 V, about 2.0 V, and about 3.5 V were examined. The SEM photographs of the copper alloy anodes at about 0.7 V showed deep grooving of boundaries between grains, thus showing a difference in the dissolution rate of the grains in comparison to the grain boundaries. Thus, the SEM photographs confirmed that at an about 0.7 V applied potential to copper alloy anodes, the surface of the anodes is more likely to produce sludge from particles falling from the surface of the anodes. The SEM photographs of the copper alloy anodes at about 2.0 V showed anode surfaces which were smoother. Cracks (i.e. grain boundaries) were present but they were small and separated. The SEM photographs of the copper alloy anodes at about 3.5 V showed anode surfaces which were even smoother and had a further decrease in the number and the size of the cracks. Thus, at an applied potential of about 2.0 V and at about 3.5 V to copper alloy anodes, the surface of the anodes was less likely to have particles fall off producing sludge.

Furthermore, anodes comprising tellurium produced a reduced amount of anode sludge in solution #1 and in solution #2 as shown in Table 3 and Table 4. Copper alloy anodes C10100 and C14500 both comprised an alloy of copper and tellurium.

Figure 12:
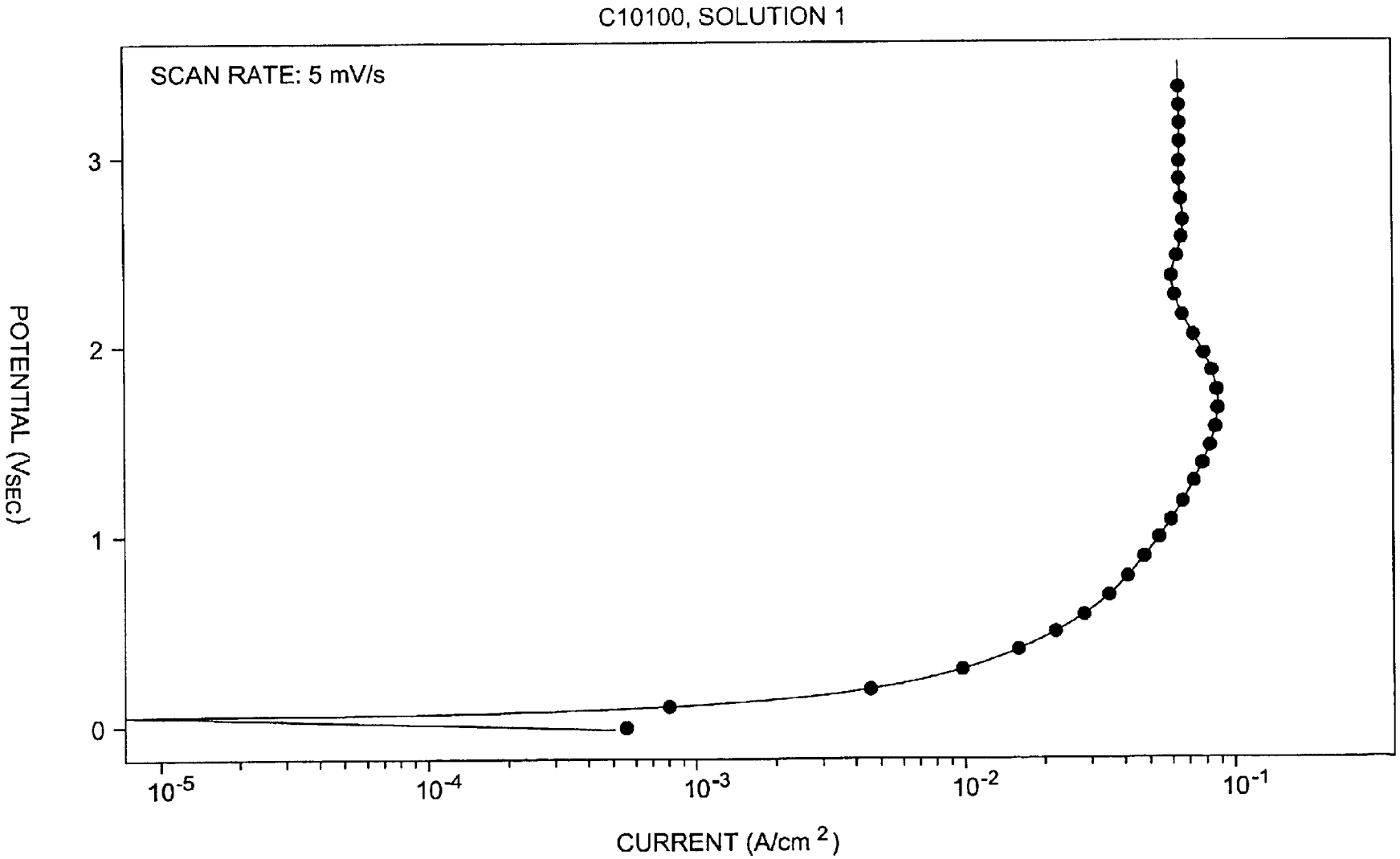
FIG. 12 is a potentiodynamic curve of a copper alloy anode in solution #1.
Figure 13:
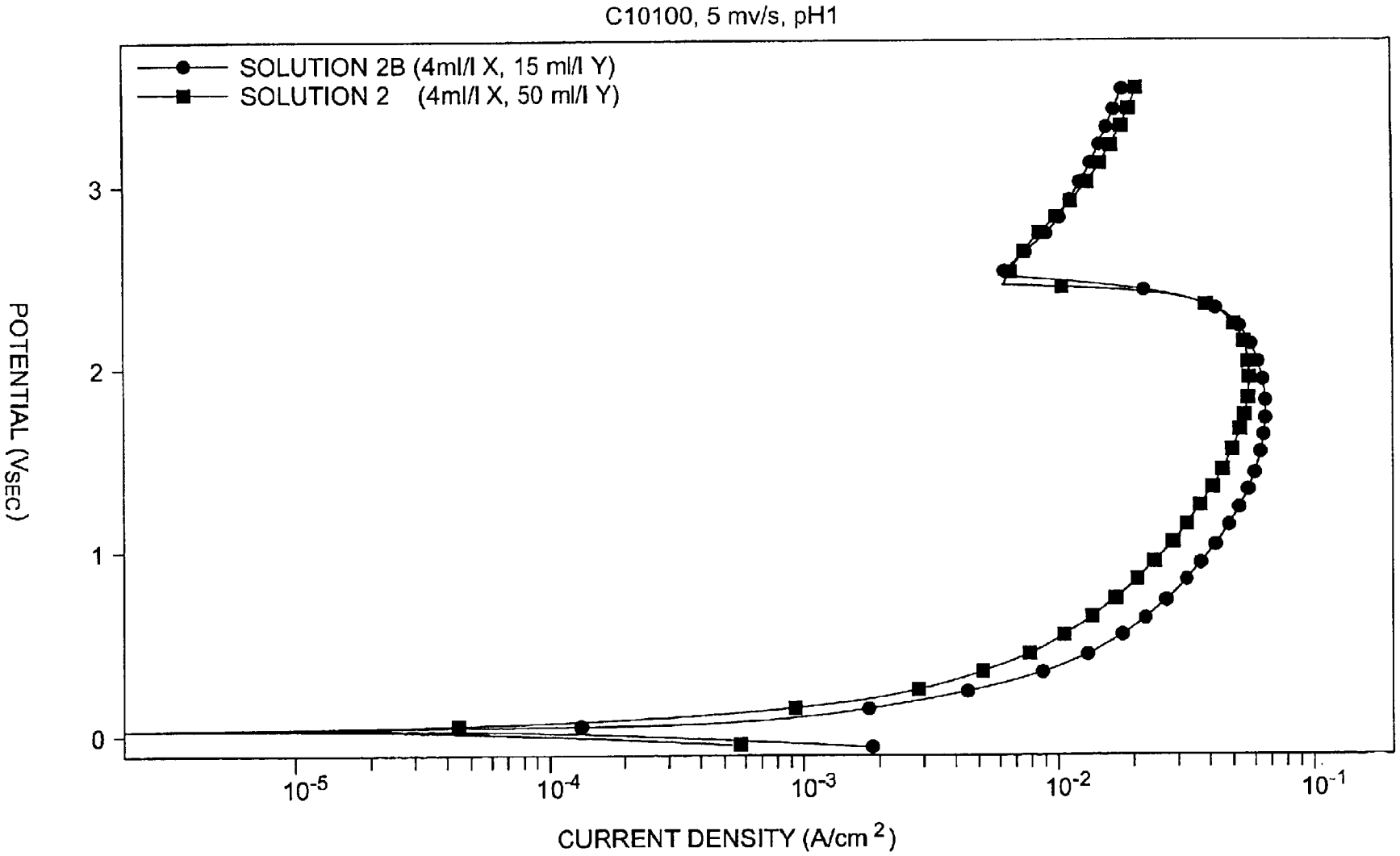
FIG. 13 is a potentiodynamic curve of a copper alloy anode in solution #2.
Figure 14:
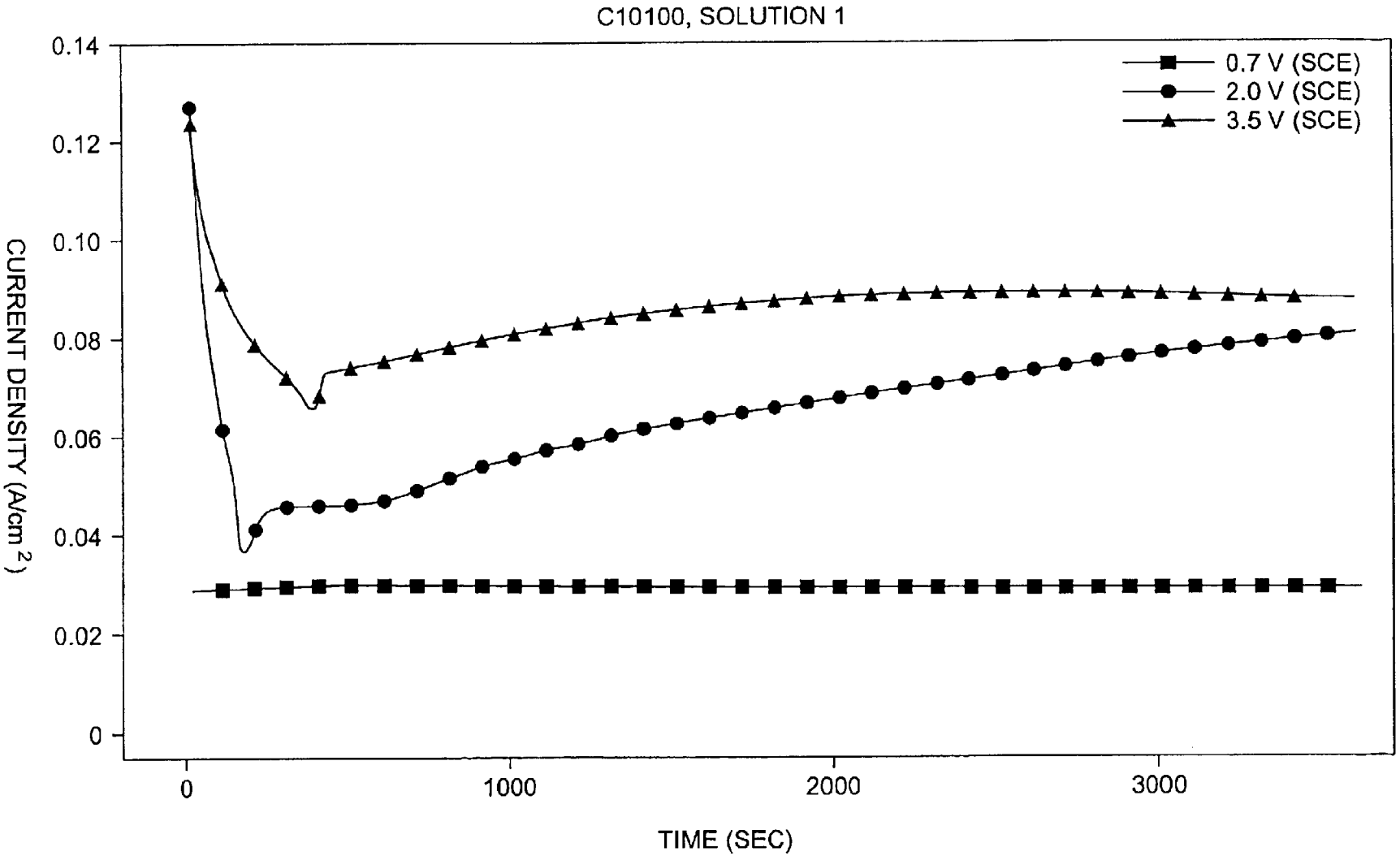
FIG. 14 is a graph of current density transients during potentiostatic anodic polarization of a copper alloy anode in solution #1.
Figure 15:
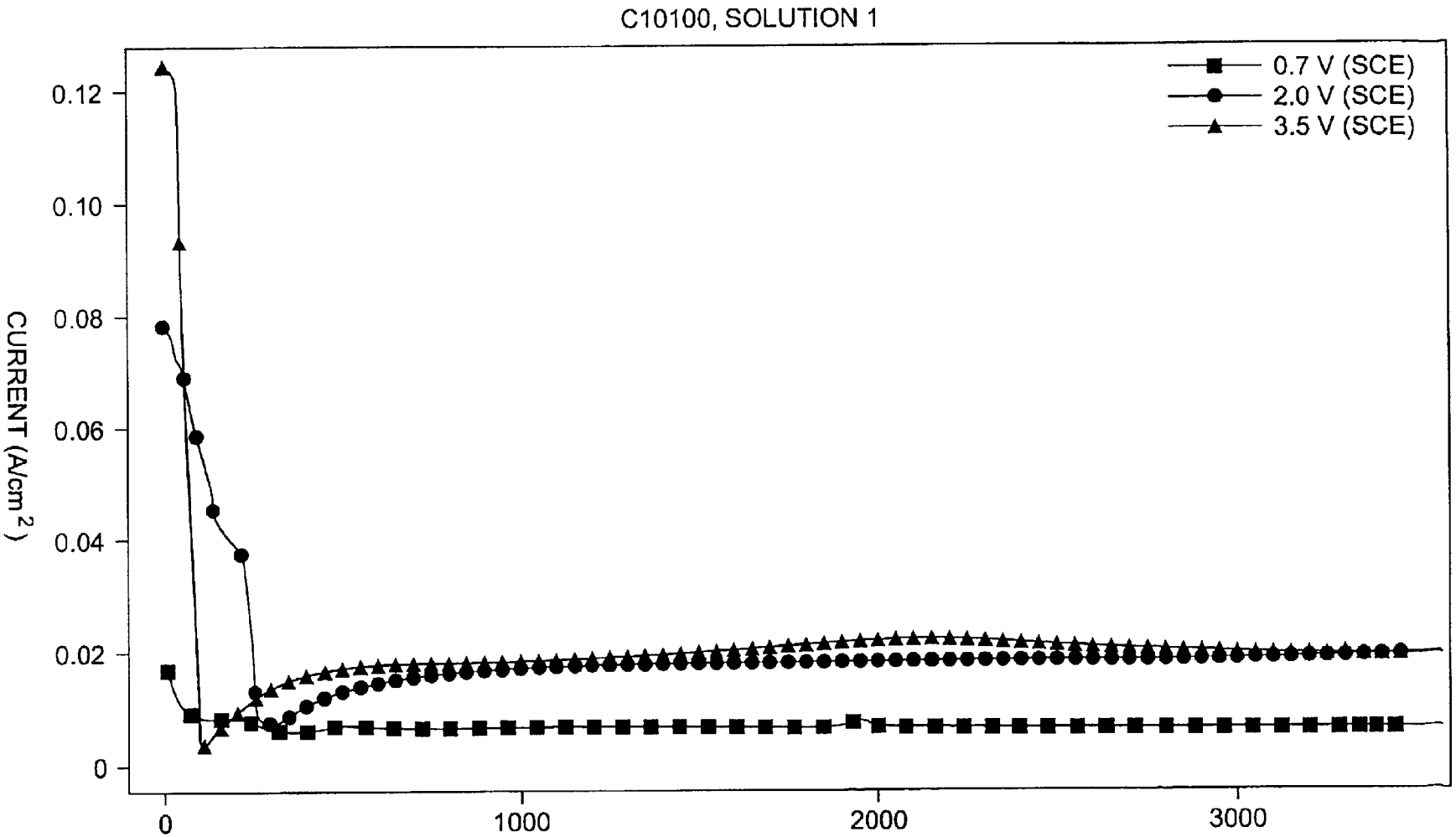
FIG. 15 is a graph of current density transients during potentiostatic anodic polarization of a copper alloy anode in solution #2.

In addition, potentiodynamic scans of the copper alloy C10100 anode were measured with a saturated calomel electrode with a scan rate of 5 mV/s in solution #1, as shown in FIG. 12, and in solution #2, and as shown in FIG. 13. Potentiostatic measurements of the copper alloy C10100 anode were conducted at an applied potential to the anode of about 0.7 V, about 2.0 V, and about 3.5 V in reference to a saturated calomel electrode in solution #1, as shown in FIG. 14, and in solution #2, as shown in FIG. 15.

TABLE 1

| Copper Alloy Anode | Cu min | Ag max | As max | Sb max | P max | Te max | Others |
|---|---|---|---|---|---|---|---|
| C10100 | 99.99 | 0.0025 | 0.0005 | 0.0004 | 0.0003 | 0.0002 | 1–25 ppm Bi, Cd, Fe, Mn, Ni, O, Se, S, Sn, Zn, Pb |
| C10300 | 99.95 | — | — | — | 0.001–0.005 | — | — |
| C10800 | 99.95 | — | — | — | 0.005–0.012 | — | — |
| C12200 | 99.9 | — | — | — | 0.015–0.040 | — | — |
| C12220 | 99.9 | — | — | — | 0.040–0.065 | — | — |

TABLE 1-continued

| Copper Alloy Anode | Cu min | Ag max | As max | Sb max | P max | Te max | Others |
|---|---|---|---|---|---|---|---|
| C14500 | 99.90 | — | — | — | 0.004–0.012 | 0.4–0.7 | — |
| C15000 | 99.80 | — | — | — | — | — | 0.10–0.20 Zr |

TABLE 2

| | Solution 1 | Solution 2 |
|---|---|---|
| $CuSO_4$ | 0.85 M | 0.85 M |
| $Cl^-$ | 60 ppm | 60 ppm |
| Additive A | 1 ml/L | — |
| Additive B | 1 ml/L | — |
| Additive C | 10 ppm | — |
| Additive X | — | 4 ml/L |
| Additive Y | — | 15 ml/L to 50 ml/L |
| pH | 2 | 1 |
| Temperature | 25° C. | 15° C. |

TABLE 3

| Copper Alloy | Sludge Amount ($g/cm^2$) | | |
|---|---|---|---|
| Anode | 0.7 V (SCE) | 2.0 V (SCE) | 3.5 V (SCE) |
| C10100 | 0.0611 | 0.0045 | 0.0015 |
| C10300 | 0.0643 | 0.0092 | 0.0049 |
| C10800 | 0.0080 | 0.0094 | 0.0035 |
| C12200 | 0.0036 | 0.0039 | 0.0032 |
| C12220 | 0.0005 | 0.0005 | 0.0026 |
| C14500 | 0.0017 | 0.0050 | 0.0000 |
| C15000 | 0.0037 | 0.0034 | 0.0046 |

TABLE 4

| Copper Alloy | Sludge Amount ($g/cm^2$) | | |
|---|---|---|---|
| Anode Material | 0.7 V (SCE) | 2.0 V (SCE) | 3.5 V (SCE) |
| C10100 | 0.0068 | 0.0000 | 0.0000 |
| C10300 | 0.0108 | 0.0065 | 0.0027 |
| C10800 | 0.0111 | 0.0059 | 0.0025 |
| C12200 | 0.0111 | 0.0054 | 0.0040 |
| C12220 | 0.0044 | 0.0039 | 0.0032 |
| C14500 | 0.0117 | 0.0003 | 0.0002 |
| C15000 | 0.0203 | 0.0070 | 0.0051 |

While the foregoing is directed to embodiments of the present invention, other and further embodiments of the invention may be devised without departing from the basic scope thereof, and the scope thereof is determined by the claims that follow.

What is claimed is:

1. A method of reducing sludge formation during electroplating of copper over a substrate, comprising:

applying a current between a consumable anode comprising copper and the substrate so that the consumable anode is at a potential of greater than or equal to about 2.2 V in reference to the normal hydrogen scale.

2. The method of claim 1, wherein the applying a current comprises providing a current density to the substrate between about 5 $mA/cm^2$ and about 600 $mA/cm^2$.

3. The method of claim 2, wherein the current density to the substrate is between about 10 $mA/cm^2$ and about 60 $mA/cm^2$.

4. The method of claim 1, wherein the consumable anode has an exposed surface area to an electrolyte solution less than an exposed surface area of the substrate to the electrolyte solution.

5. The method of claim 1, wherein the consumable anode has an exposed surface area to an electrolyte solution less than or equal to one-half of an exposed surface area of the substrate to the electrolyte solution.

6. The method of claim 4, wherein the consumable anode has a diameter substantially equal to a diameter of the substrate.

7. The method of claim 4, wherein the consumable anode has a diameter less than a diameter of the substrate.

8. The method of claim 4, wherein the consumable anode has holes formed therethrough, the method further comprising flowing the electrolyte solution through the holes of the consumable anode.

9. The method of claim 1, wherein the applying a current comprises maintaining the consumable anode at the potential of greater than or equal to about 2.2 V in reference to the normal hydrogen scale for a time period of about 50% or more of a time period for electroplating of the substrate.

10. The method of claim 1, wherein the applying a current comprises maintaining the consumable anode at the potential of greater than or equal to about 2.2 V in reference to the normal hydrogen scale during substantially an entire period of electroplating of the substrate.

11. The method of claim 1, wherein the applying a current comprises monitoring the consumable anode with a reference electrode and adjusting the current between the consumable anode and the substrate.

12. The method of claim 1, wherein the applying a current comprises determining a relationship of an applied current between the consumable anode and the substrate under the potential of greater than or equal to about 2.2 V to the consumable anode and adjusting the current based upon the relationship.

13. A method of reducing sludge formation during electroplating of copper over a substrate, comprising:

applying a current between a consumable anode comprising copper and the substrate so that the consumable anode is at a potential of greater than or equal to about 3.7 V in reference to the normal hydrogen scale.

14. The method of claim 13, wherein the applying a current comprises providing a current density to the substrate between about 5 $mA/cm^2$ and about 600 $mA/cm^2$.

15. The method of claim 14, wherein the current density to the substrate is between about 10 $mA/cm^2$ and about 60 $mA/cm^2$.

16. The method of claim 13, wherein the consumable anode has an exposed surface area to an electrolyte solution less than an exposed surface area of the substrate to the electrolyte solution.

17. The method of claim 13, wherein the consumable anode has an exposed surface area of to an electrolyte solution less than or equal to one-half of an exposed surface area of the substrate to the electrolyte solution.

18. The method of claim 16, wherein the consumable anode has a diameter substantially equal to a diameter of the substrate.

19. The method of claim 16, wherein the consumable anode has a diameter less than a diameter of the substrate.

20. The method of claim 16, wherein the consumable anode has holes formed therethrough, the method further comprising flowing the electrolyte solution through the holes of the consumable anode.

21. The method of claim 13, wherein the applying a current comprises maintaining the consumable anode at the potential of greater than or equal to about 3.7 V in reference to the normal hydrogen scale for a time period of about 50% or more of a time period for electroplating of the substrate.

22. The method of claim 13, wherein the applying a current comprises maintaining the consumable anode at the potential of greater than or equal to about 3.7 V in reference to the normal hydrogen scale during substantially an entire period of electroplating of the substrate.

23. The method of claim 13, wherein the applying a current comprises monitoring the consumable anode with a reference electrode and adjusting the current between the consumable anode and the substrate.

24. The method of claim 13, wherein the applying a current comprises determining a relationship of an applied current between the consumable anode and the substrate under the potential of greater than or equal to about 3.7 V to the consumable anode and adjusting the current based upon the relationship.

25. A method of reducing sludge formation during electroplating of copper over a substrate, comprising:

providing a consumable anode comprising copper, wherein the consumable anode has an exposed surface area to an electrolyte solution less than an exposed surface area of the substrate to the electrolyte solution; and applying a current between the consumable anode and the substrate so that the consumable anode is at a potential of greater or equal to about 0.9 V in reference to the normal hydrogen scale and so that a current density to the substrate is between about 10 mA/cm$^2$ and about 60 mA/cm$^2$.

26. The method of claim 25, wherein the applying a current comprises maintaining the consumable anode at the potential of greater than or equal to about 0.9 V in reference to the normal hydrogen scale during substantially an entire period of electroplating of the substrate.

27. A method of reducing sludge formation during electroplating of copper over a substrate, comprising:

providing a consumable anode comprising copper, wherein the consumable anode has an exposed surface area to an electrolyte solution less than or equal to one-half of an exposed surface area of the substrate to the electrolyte solution; and applying a current between the consumable anode and the substrate so that the consumable anode is at a potential of greater than or equal to about 0.9 V in reference to the normal hydrogen scale.

28. The method of claim 27, wherein the consumable anode has a diameter substantially equal to a diameter of the substrate.

29. The method of claim 27, wherein the consumable anode has a diameter less than a diameter of the substrate.

30. The method of claim 27, wherein the consumable anode has holes formed therethrough, the method further comprising flowing the electrolyte solution through the holes of the consumable anode.

31. A method of reducing sludge formation during electroplating of copper over a substrate, comprising:

providing a consumable anode comprising copper; and applying a current between the consumable anode and the substrate so that the consumable anode is at a potential of greater than or equal to about 0.9 V in reference to the normal hydrogen scale and so that a current density provided to the consumable anode is greater than or equal to 40 mA/cm$^2$.

32. The method of claim 31, wherein the current density to the consumable anode is greater than or equal to 90 mA/cm$^2$.

33. A method of reducing sludge formation during electroplating of copper over a substrate, comprising:

providing a current between the consumable anode comprising copper and tellurium and a substrate to electroplate copper from the consumable anode onto the substrate, wherein the current is applied at a potential greater than or equal to about 0.9 V in reference to the normal hydrogen scale.

34. A method of electroplating a substrate utilizing a consumable anode assembly, comprising:

providing a reference electrode proximate the consumable anode assembly;

providing a current to the consumable anode assembly;

measuring a potential applied to the consumable anode assembly with the reference electrode; and adjusting the current to the consumable anode based upon a measured potential by the reference electrode, wherein the current is adjusted so that an adjusted potential applied to the consumable anode is greater than or equal to about 0.9 V in reference to the normal hydrogen scale.

35. The method of claim 34, wherein the current is adjusted so that an adjusted potential applied to the consumable anode is greater than or equal to about 2.2 V in reference to the normal hydrogen scale.

36. The method of claim 34, wherein the current is adjusted so that an adjusted potential applied to the consumable anode is greater than or equal to about 3.7 V in reference to the normal scale.

37. An electroplating apparatus, comprising:

an electroplating cell having a cavity;

a consumable anode comprising copper end disposed in the cavity;

a contract ring adapted to receive a substrate; and a power source coupled to the consumable anode and the contact ring and adapted to provide a current between the consumable anode and the substrate so that the consumable anode is at a potential of greater than or equal to about 2.2 V in reference to the normal hydrogen scale.

38. The apparatus of claim 37, wherein the power source is adapted to provide a current between the consumable anode and the substrate so that the consumable anode is at a potential of greater than or equal to about 3.7 V in reference to the normal hydrogen scale.

39. The apparatus of claim 37, wherein the power source is adapted to provide a current density to the substrate between about 5 mA/cm$^2$ and about 600 mA/cm$^2$.

40. The apparatus of claim 37, wherein the power source is adapted to provide a current density to the substrate between about 10 mA/cm$^2$ and about 60 mA/cm$^2$.

41. The apparatus of claim 37, wherein the power source is adapted to provide a current density greater than or equal to 40 mA/cm$^2$ to the consumable anode.

42. The apparatus of claim 37, wherein the power source is adapted to provide a current density greater than or equal to 90 mA/cm$^2$to the consumable anode.

43. An apparatus adapted to reduce the formation of sludge in an electroplating cell adapted to receive a substrate having an exposed surface area in contact with an electrolyte solution, the apparatus comprising:

a consumable anode adapted to have an exposed surface area in contact with the electrolyte solution, the exposed surface area of the consumable anode is less than the exposed surface area of the substrate.

44. The apparatus of claim 43, wherein the exposed surface area of the consumable anode is less than or equal to about one-half the exposed surface area of the substrate.

45. The apparatus of claim 43, the exposed surface area of the consumable anode is less than or equal to about one-third the exposed surface area of the substrate.

46. The apparatus of claim 43, wherein the exposed surface area of the consumable anode is less than or equal to about one-fourth the exposed surface area of the substrate.

47. The apparatus of claim 43, wherein the exposed surface area of the consumable anode is greater than or equal to about ½ the exposed surface area of the substrate.

48. The apparatus of claim 43, wherein the exposed surface area of the consumable anode is greater than or equal to about 1/10 the exposed surface area of the substrate.

49. The apparatus of claim 43, wherein the consumable anode is at least partially surrounded by an impermeable membrane.

50. The apparatus of claim 43, wherein the consumable anode comprises copper.

51. The apparatus of claim 50, wherein the consumable anode further comprises tellurium.

52. The apparatus of claim 43, where the consumable anode comprises a plate.

53. The apparatus of claim 43, where the consumable anode comprises an array.

54. The apparatus of claim 43, wherein the consumable anode has holes formed therethrough.

55. The apparatus of claim 54, wherein the consumable anode comprises a perforated anode.

56. The apparatus of claim 54, wherein the consumable anode comprises a mesh.

57. The apparatus of claim 43, further comprising an insulator partially covering the consumable anode.

58. An apparatus adapted to reduce the formation sludge in an electroplating cell adapted to receive a substrate having an exposed surface area in contact with an electrolyte solution, the apparatus comprising:

a consumable anode adapted to have an exposed surface area in contact with the electrolyte solution, wherein the exposed surface area of the consumable anode is less than the exposed surface area of the substrate a wherein the consumable anode has a diameter substantially equal to a diameter of the substrate.

59. The apparatus of claim 58, wherein the exposed surface area of the consumable anode is less than or equal to about one-half the exposed surface area of the substrate.

60. The apparatus of claim 58, wherein the exposed surface area of the consumable anode is less than or equal to about on third the exposed surface area of the substrate.

61. The apparatus of claim 58, wherein the exposed surface area of the consumable anode is less than or equal to about one-fourth the exposed surface area of the substrate.

62. An apparatus adapted to reduce the formation of sludge in an electroplating cell adapted to receive a substrate having an exposed surface area in contact with an electrolyte solution, the apparatus comprising:

a consumable anode adapted to have an exposed surface area in contact with the electrolyte solution, the exposed surface area of the consumable anode is less than the exposed surface area of the substrate, the consumable anode having a diameter less than a diameter of the substrate.

63. The apparatus of claim 62, wherein the exposed surface area of the consumable anode is less than or equal to about one-half the exposed surface area of the substrate.

64. The apparatus of claim 62, wherein the exposed surface area of the consumable anode is less than or equal to about one-third the expose surface area of the substrate.

65. The apparatus of claim 62, wherein the exposed surface area of the consumable anode is less than or equal to about one-fourth the exposed surface area of the substrate.

66. An apparatus adapted to reduce the formation of sludge in an electroplating cell adapted to receive a substrate having an exposed surface area in contact with an electrolyte solution, the apparatus comprising:

a consumable anode; and an insulator partially covering the consumable anode to limit an exposed surface area of the consumable anode in contact with the electrolyte solution to be less than the exposed surface area of the substrate.

67. The apparatus of claim 66, wherein the exposed surface area of the consumable anode is less than or equal to about one-half the exposed surface area of the substrate.

68. The apparatus of claim 66, wherein the exposed surface area of the consumable anode is less than or equal to about one-third the expose surface area of the substrate.

69. The apparatus of claim 66, wherein the exposed surface area of the consumable anode is less than or equal to about one-fourth the exposed surface area of the substrate.

70. The apparatus of claim 66, where the consumable anode comprises a plate.

71. The apparatus of claim 66, where the consumable anode comprises an array.

72. The apparatus of claim 66, wherein the consumable anode has holes formed therethrough.

73. The apparatus of claim 72, wherein the consumable anode comprises a perforated anode.

74. The apparatus of claim 72, wherein the insulator completely fills the holes of the consumable anode.

75. The apparatus of claim 72, wherein the insulator covers walls of the holes of the consumable anode permitting flow a fluid through the holes of the consumable anode.

76. An electroplating apparatus, comprising:

an electroplating cell having a cavity;

a contact ring adapted to receive a substrate having an exposed surface area in contact with an electrolyte solution;

a consumable anode disposed in the cavity and adapted to having an exposed surface area in contact with the electrolyte solution, the exposed surface area of the consumable anode is less than or equal to about one-half the exposee surface area of the substrate; and a power source coupled to the consumable anode and the contact ring; the power source adapted to provide a current density to the substrate between about 6 $mA/cm^2$ and about 60 $mA/cm^2$.

77. The electroplating apparatus of claim 76, wherein the consumable anode has a diameter substantially equal to a diameter of the substrate.

78. The electroplating apparatus of claim 76, wherein the consumable anode has a diameter less than a diameter of the substrate.

79. The electroplating apparatus of claim 76, further comprising an insulator partially cover the consumable anode to limit the exposed surface area of the consumable anode in contact with the electrolyte solution.

80. The electroplating apparatus of claim 76, further comprising a reference electrode disposed proximate the consumable anode.

* * * * *

UNITED STATES PATENT AND TRADEMARK OFFICE

CERTIFICATE OF CORRECTION

PATENT NO. : 6,830,673 B2
APPLICATION NO. : 10/039275
DATED : December 14, 2004
INVENTOR(S) : Joseph Yahalom, David Starosvetsky and Joseph Hazan It is certified that error appears in the above-identified patent and that said Letters Patent is hereby corrected as shown below:

In the Claims

Column 13, Claim 25, Line 38: After "greater", insert --than--

Column 15, Claim 47, Line 18: Change "$^1/_2$" to --$^1/_{12}$--

Column 15, Claim 58, Line 40: Before "sludge", insert --of--

Signed and Sealed this

Fifteenth Day of August, 2006

JON W. DUDAS
*Director of the United States Patent and Trademark Office*